US006259340B1

(12) United States Patent
Fuhr et al.

(10) Patent No.: US 6,259,340 B1
(45) Date of Patent: Jul. 10, 2001

(54) CIRCUIT BREAKER WITH A DUAL TEST BUTTON MECHANISM

(75) Inventors: Kevin Fuhr, Goshen; Ray Seymour, Plainville; Doug Tilghman, Bristol; Brenda Zhang, West Hartford, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/307,661

(22) Filed: May 10, 1999

(51) Int. Cl.[7] ..... H01H 73/00
(52) U.S. Cl. ..... 335/18; 361/42
(58) Field of Search ..... 335/35, 18; 361/42–50

(56) References Cited

U.S. PATENT DOCUMENTS

| | | | |
|---|---|---|---|
| 3,401,363 | 9/1968 | Vyskocil et al. | 335/17 |
| 3,443,258 | 5/1969 | Dunham et al. | 337/79 |
| 3,596,218 | 7/1971 | Layton | 335/17 |
| 3,596,219 | 7/1971 | Erickson | 335/17 |
| 4,208,690 | 6/1980 | McGinnis et al. | 361/48 |
| 4,345,288 | 8/1982 | Kampf et al. | 361/31 |
| 4,466,071 | 8/1984 | Russell, Jr. | 364/492 |
| 4,513,268 | 4/1985 | Seymour et al. | 335/35 |
| 4,513,342 | 4/1985 | Rocha | 361/94 |
| 4,552,018 | 11/1985 | Legatti et al. | 73/431 |
| 4,573,259 | 3/1986 | Seymour et al. . | |
| 4,589,052 | 5/1986 | Dougherty | 361/94 |
| 4,598,183 | 7/1986 | Gardner et al. | 200/50 A |
| 4,641,216 | 2/1987 | Morris et al. | 361/45 |
| 4,641,217 | 2/1987 | Morris et al. | 361/45 |
| 4,658,322 | 4/1987 | Rivera | 361/37 |
| 4,667,263 | 5/1987 | Morris et al. | 361/42 |
| 4,672,501 | 6/1987 | Bilac et al. | 361/96 |
| 4,686,600 | 8/1987 | Morris et al. | 361/42 |
| 4,688,134 | 8/1987 | Freeman et al. | 361/45 |
| 4,702,002 | 10/1987 | Morris et al. | 29/837 |
| 4,847,850 | 7/1989 | Kafka et al. | 372/71 |
| 4,851,951 * | 7/1989 | Foster, Jr. | 361/50 |
| 4,878,143 | 10/1989 | Kalal et al. | 361/94 |
| 4,878,144 | 10/1989 | Nebon | 361/96 |
| 4,931,894 | 6/1990 | Legatti | 361/45 |
| 4,936,894 | 6/1990 | Larson et al. | 70/298 |
| 5,089,796 | 2/1992 | Glennon et al. | 335/172 |
| 5,121,282 | 6/1992 | White | 361/42 |
| 5,185,684 | 2/1993 | Beihoff et al. | 361/45 |
| 5,185,685 | 2/1993 | Tennies et al. | 361/45 |
| 5,185,686 | 2/1993 | Hansen et al. | 361/45 |
| 5,185,687 | 2/1993 | Beihoff et al. | 361/45 |
| 5,206,596 | 4/1993 | Beihoff et al. | 324/536 |
| 5,208,542 | 5/1993 | Tennies et al. | 324/544 |
| 5,223,682 | 6/1993 | Pham et al. | 200/148 R |
| 5,224,006 | 6/1993 | MacKenzie | 361/45 |
| 5,229,730 | 7/1993 | Legatti et al. | 335/18 |
| 5,245,302 | 9/1993 | Brune et al. | 335/35 |
| 5,245,498 | 9/1993 | Uchida et al. | 361/47 |
| 5,250,918 | 10/1993 | Edds et al. | 335/35 |

(List continued on next page.)

FOREIGN PATENT DOCUMENTS

| | | |
|---|---|---|
| 2036032 | 8/1991 | (CA) . |
| WO 91/13454 | 9/1991 | (WO) . |
| WO 95/20235 | 7/1995 | (WO) . |

*Primary Examiner*—Lincoln Donovan
(74) *Attorney, Agent, or Firm*—Cantor Colburn LLP; Carl B. Horton

(57) ABSTRACT

In an exemplary embodiment of the invention, a dual test mechanism is presented for use in a circuit breaker. More specifically, the dual test mechanism includes a dual test button which comprises a single switch for testing both the AFCI and GFCI circuits of the breaker. The test mechanism includes a circuit board, which forms a part of the circuit breaker, and a test button assembly which includes a test button and signaling components which are electrically connected to the circuit board.

16 Claims, 5 Drawing Sheets

U.S. PATENT DOCUMENTS

| | | | | |
|---|---|---|---|---|
| 5,299,730 | | 4/1994 | Pasch et al. | 228/180.22 |
| 5,303,113 | | 4/1994 | Goleman et al. | 361/93 |
| 5,307,230 | | 4/1994 | MacKenzie | 361/96 |
| 5,359,293 | | 10/1994 | Boksiner et al. | 324/544 |
| 5,418,463 | | 5/1995 | Fleming et al. | 324/520 |
| 5,420,740 | | 5/1995 | MacKenzie et al. | 361/45 |
| 5,432,455 | | 7/1995 | Blades | 324/536 |
| 5,434,509 | | 7/1995 | Blades | 324/536 |
| 5,452,223 | | 9/1995 | Zuercher et al. | 364/483 |
| 5,453,723 | | 9/1995 | Fello et al. | 335/18 |
| 5,459,630 | * | 10/1995 | Mackenzie et al. | 361/45 |
| 5,475,609 | | 12/1995 | Apothaker | 364/492 |
| 5,483,211 | | 1/1996 | Carrodus et al. | 335/18 |
| 5,485,093 | | 1/1996 | Russell et al. | 324/522 |
| 5,493,278 | | 2/1996 | MacKenzie et al. | 340/638 |
| 5,506,789 | | 4/1996 | Russell et al. | 364/492 |
| 5,510,946 | | 4/1996 | Franklin | 361/56 |
| 5,510,949 | | 4/1996 | Innes | 361/93 |
| 5,512,832 | | 4/1996 | Russell et al. | 324/522 |
| 5,519,561 | | 5/1996 | Mrenna et al. | 361/105 |
| 5,546,266 | | 8/1996 | MacKenzie et al. | 361/93 |
| 5,550,751 | | 8/1996 | Russell | 364/492 |
| 5,552,755 | * | 9/1996 | Fello et al. | 335/18 |
| 5,561,605 | | 10/1996 | Zuercher et al. | 364/483 |
| 5,578,931 | | 11/1996 | Russell et al. | 324/536 |
| 5,583,732 | | 12/1996 | Seymour et al. | 361/93 |
| 5,590,012 | | 12/1996 | Dollar, II | 361/113 |
| 5,600,526 | | 2/1997 | Russell et al. | 361/65 |
| 5,614,878 | | 3/1997 | Patrick et al. | 335/14 |
| 5,615,075 | | 3/1997 | Kim | 361/87 |
| 5,629,824 | | 5/1997 | Rankin et al. | 361/57 |
| 5,659,453 | | 8/1997 | Russell et al. | 361/93 |
| 5,694,101 | | 12/1997 | Lavelle et al. | 335/172 |
| 5,706,154 | | 1/1998 | Seymour | 361/42 |
| 5,818,671 | | 10/1998 | Seymour et al. | 361/42 |
| 5,831,500 | | 11/1998 | Turner et al. | 335/17 |
| 5,896,262 | * | 4/1999 | Rae et al. | 361/94 |

* cited by examiner

CIRCUIT BREAKER WITH A DUAL TEST BUTTON MECHANISM

BACKGROUND OF THE INVENTION

The present invention relates generally to a circuit breaker. More specifically the present invention relates to a dual test button and test mechanism to check both an arc fault circuit interruption (AFCI) and a ground fault circuit interruption (GFCI) in a circuit breaker.

Conventional residential and light industrial and commercial circuit breakers typically have a thermal trip mechanism which responds to persistent overcurrents of moderate magnitude to provide a delayed trip in the breaker. Also included in the circuit breaker is a magnetic trip mechanism which responds instantaneously to overcurrent conditions of greater magnitudes. It is becoming more common for these circuit breakers to further include a ground fault trip mechanism as one of the active mechanisms. The ground fault trip mechanism includes a trip unit which detects faults between the line conductor and ground and the neutral conductor and ground. Line to ground faults are commonly detected by the use of a differential transformer. The line and neutral conductors are passed through the coil so that in the absence of a line to ground fault, the currents are equal and opposite and no signal is generated. However, when a line to ground fault exists, it creates a sizeable imbalance between the two currents in the two conductors which can be level detected As is known, a neutral to ground fault may be detected by injecting a signal onto the neutral conductor which will produce an oscillation if feedback is provided.

In addition, conventional circuit breakers include mechanisms designed to protect against arc faults. For example, an arc fault may occur in the device when bare or stripped conductors come into contact with one another and the current caused by such a fault produces magnetic repulsion forces which push the conductors apart, thereby striking an arc. The arc that is caused by these faults can damage the conductors by melting the copper therein and this is especially true for stranded wire conductors such as extension cords, which can ignite surrounding materials.

Typically, the circuit breaker includes contacts that open upon sensing arcing from line to ground and/or from line to neutral. Arc fault circuit breakers typically use a differential transformer to measure arcing from line to ground. Detecting arcing from line to neutral is accomplished by detecting rapid changes in load current by measuring voltage drop across is a relatively constant resistance, usually a bi-metal resistor.

Unfortunately, many conventional circuit breakers, including residential circuit breakers, do not permit the user to test both the AFCI and GFCI circuits in the device. Furthermore, the ability to test both of these circuits is very important for customer safety and because a vast amount of individuals do not understand the implications of a circuit failure, it is important to best educate these individuals about these implications and what systems are available to minimize the likelihood that such a circuit failure occurs.

BRIEF SUMMARY OF THE INVENTION

In an exemplary embodiment of the invention, a dual test mechanism is presented for use in a circuit breaker. More specifically, the dual test mechanism includes a dual test button which comprises a single switch for testing both the AFCI and GFCI circuits of the breaker. The test mechanism includes a circuit board, which forms a part of the circuit breaker, and a test button assembly which includes a test button and signaling components which are electrically connected to the circuit board.

The test button has a first position and a second position, wherein positioning the test button in the first position produces a first signal and positioning the test button in the second position produces a second signal. A trip mechanism is included in the circuit breaker and includes a pair of separable contacts, wherein the trip mechanism is electrically connected to the circuit board so that in response to receiving one of the first and second signals, the circuit board generates a trip signal which directs the trip mechanism to separate the pair of separable contacts. In the preferred embodiment, the first position comprises a test position for the AFCI circuit and the second position comprises a test position for the GFCI circuit. Thus, the present invention permits the customer to test both the AFCI and GFCI circuits by positioning a single test button accordingly in either the first or second test button positions.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several Figures.

DETAILED DESCRIPTION OF THE INVENTION

Figure 1:
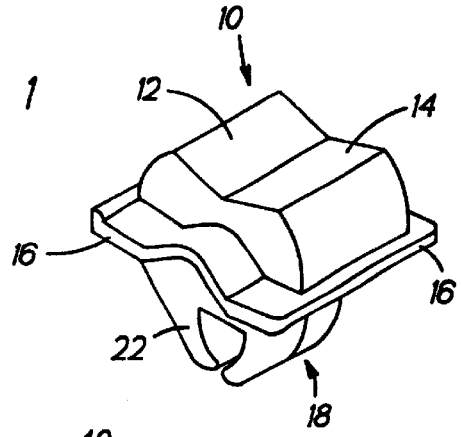
FIG. 1 is a perspective view of a dual test button for use in a dual test mechanism in accordance with the present invention.

Referring to FIG. 1, an exemplary dual test button for use to check both AFCI and GFCI circuits in a circuit breaker 100 (FIG. 4) is generally shown at 10. Test button 10 includes a first cantilevered surface 12 and a second cantilevered surface 14 which are designed as surfaces for the user to depress depending upon which circuit is to be tested in circuit breaker 100. More specifically, first cantilevered surface 12 is depressed if testing of the AFCI circuit is desired and second cantilevered surface 14 is depressed if testing of the GFCI circuit is desired. First and second cantilevered surfaces 12 and 14 are integral with one another and converge along a central line. A perimetric lip 16 extends around first and second cantilevered surfaces 12 and 14 so that surfaces 12 and 14 extend above perimetric lip 16. A bottom portion of test button 10 comprises a clamp member 18 which receives a pivotable leaf spring 20 which forms a part of a test button assembly 32 (shown in FIG. 2). Clamp member 18 has a pair of biasing arms 22 which securely hold pivotable leaf spring 20 therebetween. Pivotable leaf spring 20 pivots when either first or second cantilevered surfaces 12 and 14 are depressed. Preferably, test button 10 is formed of a plastic material as is known in the art.

Figure 2:
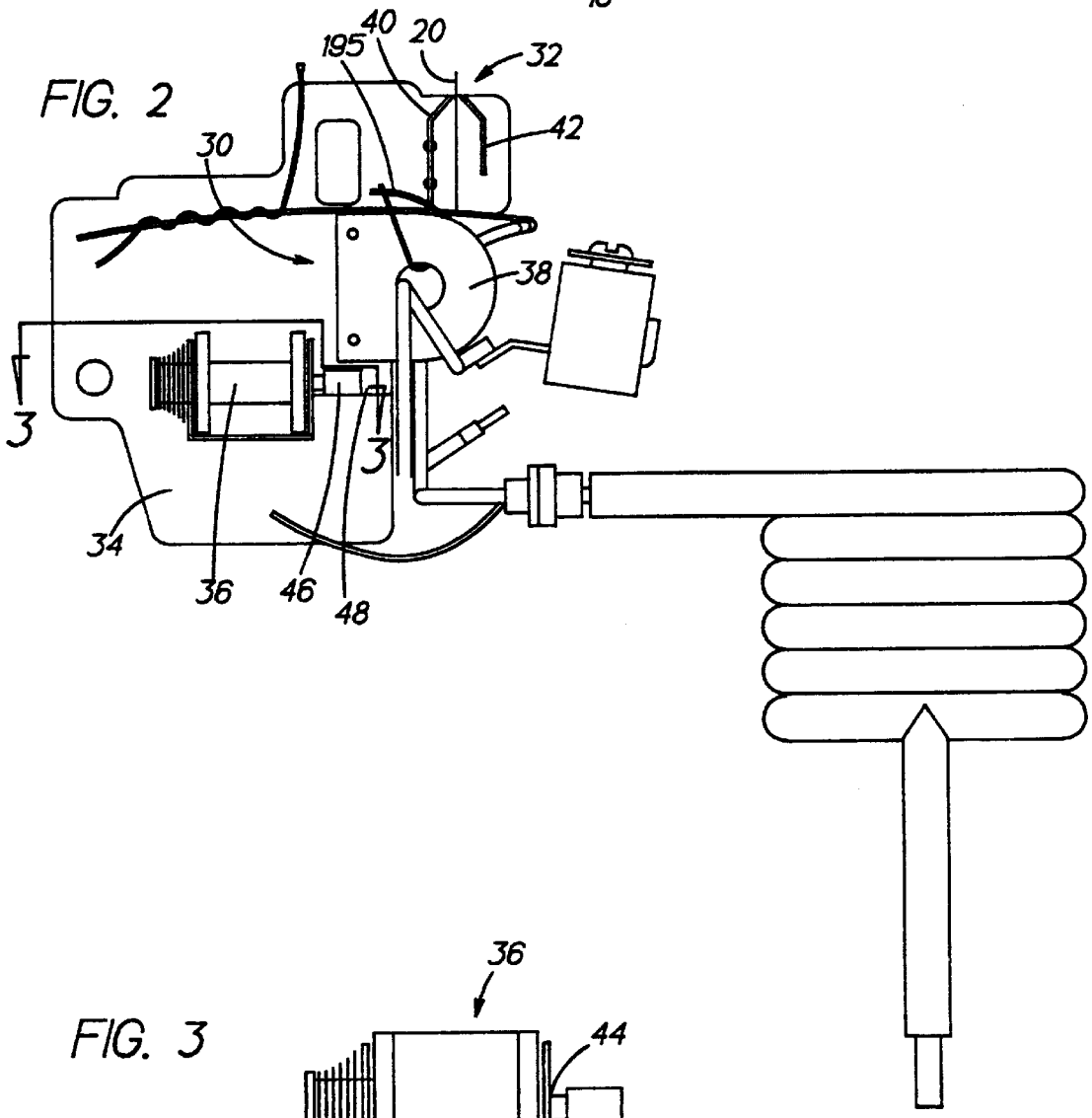
FIG. 2 is a side elevation view of an exemplary printed circuit board layout in accordance with the present invention.
Figure 3:
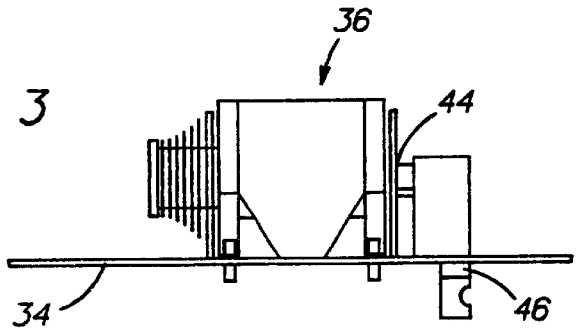
FIG. 3 is a bottom plan view of the printed circuit board of FIG. 2 taken along the line 3—3.

Turning now to FIGS. 1–3 which illustrate exemplary current sensing components 30 for use in circuit breaker 100 (FIG. 4) along with test button assembly 32. Current sensing components 30 comprise a circuit board 34 which is electrically connected to a solenoid 36 and a current sensing transformer 38. Furthermore, test button assembly 32 includes signaling components comprising a pivotable leaf spring 20 which is disposed intermediate a first flat conductor (flat) 40 and a second flat conductor (flat) 42, all of which are electrically connected to circuit board 34. Pivotable leaf spring 20 is preferably a planar member, while first and second flats 40 and 42 each have a lower planar segment and an angled upper segment which is inclined toward pivotable leaf spring 20. It being understood that test button 10 is secured to pivotable leaf spring 20 by simply inserting a top end of pivotable leaf spring 20 within clamp member 18. The biasing forces of the pair of arms 22 pinch and hold pivotable leaf spring 20 in place.

Figure 4:
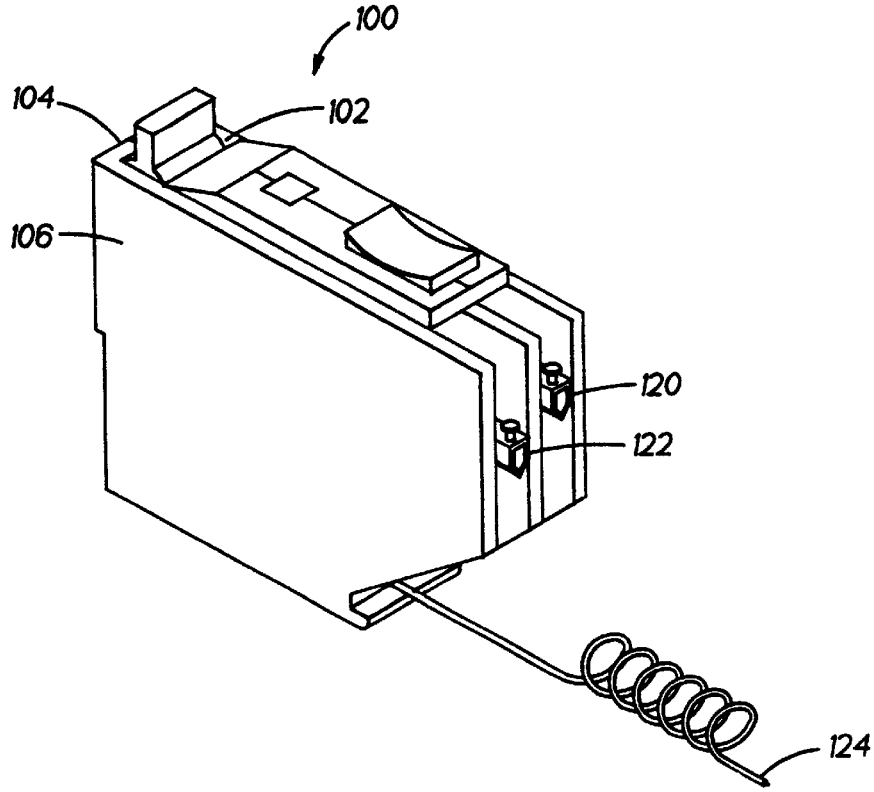
FIG. 4 is a perspective view of a single pole circuit breaker in accordance with present invention.

Test button assembly 32 comprises a two position switch assembly (AFCI and GFCI), wherein depressing first cantilevered surface 12 causes pivotable leaf spring 20 to contact second flat 42 resulting in a first signal being injected into circuit board 34, wherein the first signal comprises a test signal for the AFCI circuit. In contrast, depressing second cantilevered surface 14 causes pivotable leaf spring 20 to contact first flat 40 resulting in a second signal being injected into circuit board 34, wherein the second signal comprises a test signal for the GFCI circuit. Upon receiving either the first or the second signal, circuit board 34 generates a trip signal to solenoid 36 resulting in the actuation of solenoid 36 which causes a pair of separable contacts to separate and interrupt the current flow in circuit breaker 100 (FIG. 4). The precise testing mechanisms and signaling will be described in great detail hereinafter.

Solenoid 36 includes a plunger assembly 44 at one end, wherein plunger assembly 44 includes a rod having an end extension 46 which attaches at a right angle to the plunger rod. End extension 46 comprises the component of plunger assembly 44 which moves within a recess 48 formed in circuit board 34. Referring to FIG. 2, the actuation of solenoid 36 causes plunger assembly 44 to move in a left-to-right direction and end extension 46 moves within recess 48 in a direction away from circuit board 34. End extension 46 is intended to engage a test mechanism 200 (shown in FIG. 7) which causes the pair of contacts to separate and interrupt current flow within circuit breaker 100, as will be described hereinafter.

Figure 5:
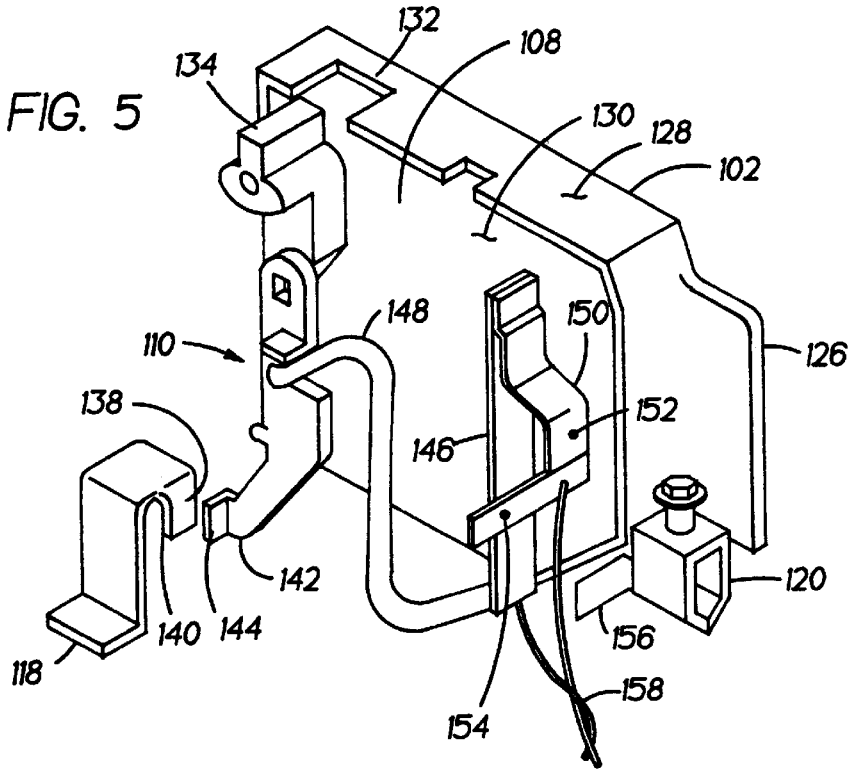
FIG. 5 is an exploded view of the mechanical compartment of the single pole circuit breaker of FIG. 4.
Figure 6:
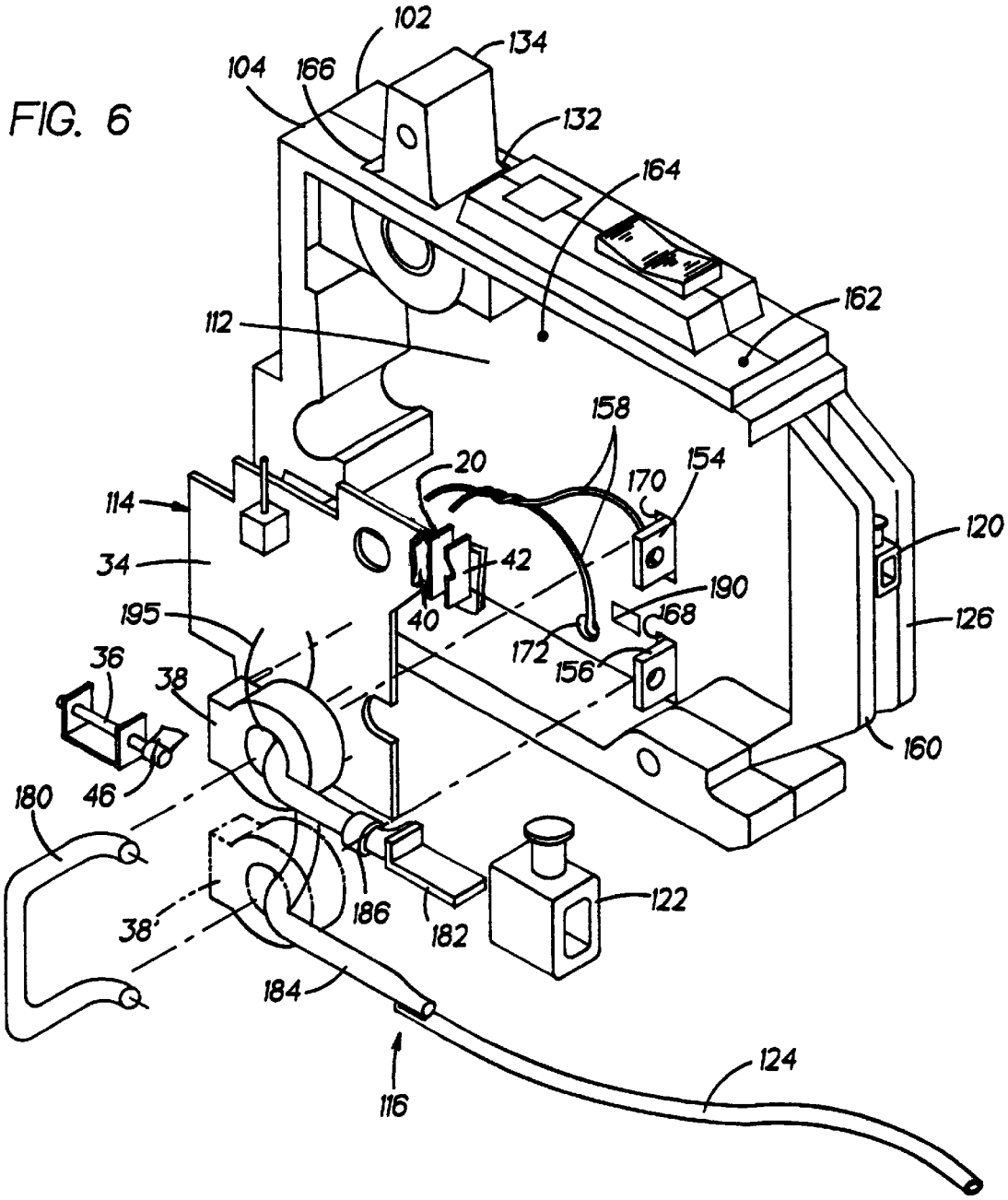
FIG. 6 is an exploded view of the electronics compartment of the single pole circuit breaker of FIG. 4.

Circuit board 34, test button assembly 32 and solenoid 36 and test mechanism 200 (FIG. 7) may be used as a component of any number of suitable circuit breakers in which the selected movement of dual test button 10 permits one of two test signals to be injected into circuit board 34 resulting in the testing of both AFCI and GFCI circuits within circuit breaker 100. For the purpose of illustration only and not limitation, an exemplary single pole arc circuit board 100 is illustrated in FIGS. 4–6 and is further described in commonly assigned U.S. patent application Ser. No. 09/246,322 filed on Feb. 9, 1999, which is hereby incorporated by reference in its entirety.

Referring to FIG. 4, circuit breaker 100 comprises a first housing 102, a second housing 104, and a cover 106 that are assembled securely together with a plurality of bolts (not shown). First housing 102 defines a mechanical compartment 108, having load current carrying and switching components 110 disposed therein (see FIG. 5). Second housing 104 defines an electronics compartment 112, having current sensing components 114 and neutral current carrying components 116 disposed therein (see FIG. 6). A load current from a source (not shown) connects to a line connection 118 (see FIG. 5), and conducts along the current carrying and switching components 110 to a load lug 120 for customer connection to a load (not shown). A neutral current from the load connects to a neutral lug 122, (see FIG. 4) and conducts along the neutral current carrying components 116 to a neutral return wire 124 for customer connection to the source. Arc faults are sensed and processed by sensing components 114. As more particularly described hereinafter, arc fault circuit breaker 100 is preferably assembled such that electrical interconnections, i.e., electrical connections between the mechanical and electronics compartments 108 and 112, are made without disassembling any previously assembled compartment.

Referring to FIG. 5, the mechanical compartment 108 is shown in detail. First housing 102 is generally rectangular in shape, and formed of electrical insulative material, i.e., plastic. First housing 102 comprises a first insulative tab 126, a first rim 128, and a first side wall 130. First tab 126 protrudes forwardly from the front of first housing 102 adjacent load lug 120 to provide an insulative barrier. First rim 128 extends around the periphery of first side wall 130. A first rectangular slot 132 is located in first rim 128 at the top and back of first housing 102 and is sized to receive a pole handle 134. First side wall 130 and first rim 128 define mechanical compartment 108 which includes the load current carrying and switching components 110. The load current carrying and switching components 110 within the mechanical compartment 108 are electrically connected, e.g., welded, bolted, or crimped, to form a load current path. The load current path begins at line connection 118 where the load current enters the mechanical compartment 108. Line connection 118 includes a lower tab 138 to connect to a source line (not shown), and a fixed contact 140 which extends downwardly from the upper end of line connection 118. A blade 142 is pivotally engaged to first housing 102 and is pivotally attached to insulated pole handle 134. A lower end of blade 142 includes a flat contact 144 which is forcibly biased against contact 140 to provide electrical continuity for the load current. Pole handle 134 is pivotally attached to first housing 102 and extends outwardly from mechanical compartment 108 into electronics compartment 112.

Blade 142 is electrically connected to a bottom distal end of a bimetal resistor 146 via a braid 148. A top distal end of bimetal resistor 146 is in turn electrically connected to an L-shaped strap 150. L-shaped strap 150 comprises a vertical strap body 152 and a horizontal strap extension 154. Horizontal strap extension 154 forms a substantially right angle with vertical strap body 152, and extends outwardly from mechanical compartment 108 into electronics compartment 112. A load terminal 156 also extends outwardly from the mechanical compartment 108 into electronics compartment 112. Load terminal 156 is in turn electrically connected to load lug 120. The load current path conducts the load current from the line connection 118, through contacts 140 and 144, through blade 142, braid 148, bimetal resistor 146, and L-shaped strap 150. At this point, the load current path passes out of the mechanical compartment 108 through horizontal strap extension 154. The load current path returns to the mechanical compartment 108 through load terminal 156 and out through the load lug 120 to the load. When an arc fault is detected the pole handle 134 pivots clockwise, which in turn pivots blade 142 to separate contacts 140 and 144 and thereby open the load current path.

A twisted pair conductor 158 is electrically connected to the bottom distal end of bimetal resistor 146 and horizontal strap extension 154 of the L-shaped strap 150 to sense arcing from the line to neutral as is well known. This is accomplished by measuring the voltage drop across the bimetal resistor 146 that results from rapid changes in load current caused by arcing from line to neutral.

Referring to FIG. 6, the electronics compartment 112 is shown in detail. Second housing 104 is generally rectangular in shape and formed of electrical insulative material, i.e., plastic. Second housing 104 comprises a second insulative tab 160, a second rim 162, and a second side wall 164. Second tab 160 protrudes forwardly from the front of second housing 104 adjacent neutral lug 122 to provide an insulative barrier. Second rim 162 extends around the periphery of second side wall 164. A second rectangular slot 166 is located in rim 162 and cooperates with slot 132 to receive and secure pole handle 134 when housings 102 and 104 are assembled together. Second side wall 164 and second rim 162 define the electronics compartment 112 which includes the current sensing components 114 and the neutral current carrying components 116. The second housing 104 is assembled securely against first housing 102 with a plurality of bolts (not shown) to enclose mechanical compartment 108 and to capture the components wiin, as well as to insulate and secure load lug 120 between tabs 126 and 160.

Second side wall 164 of second housing 104 includes rectangular through holes 168 and 170 and circular through hole 172 to provide openings in the second housing 104 to permit the load terminal 156, horizontal strap extension 154 and twisted pair conductor 158 to extend through to the electronics compartment 112. This enables all electrical interconnections between compartments 108 and 112 to be completed in electronics compartment 112. During production, this allows compartments 108 and 112 to be assembled sequentially without the need to disassemble mechanical compartment 108. That is, mechanical compartment 108 is assembled first with the interconnecting components 154, 156 and 158 extending outwardly from the compartment 108. Second housing 104 is then assembled to first housing 102 enclosing the mechanical compartment 108, but allowing the interconnecting components 154, 156, and 158 to extend therethrough. The electronics compartment 112 may then be assembled and the associated components be interconnected to the components of the mechanical compartment 108 without any disassembly of mechanical compartment 112. This provides for a large work space for tooling and assembly when interconnecting the components of the compartments 108 and 112. Therefore, high quality interconnections are more consistently, and cost effectively made then in prior art circuit breakers.

Second side wall 164 further includes a window 190, preferably in the shape of a rectangle. Window 190 is intended to receive end extension 46 of plunger 44 of solenoid 36. More specifically, end extension 46 freely moves within window 190 upon actuation of solenoid 36 after circuit board 34 generates a trip signal which is received by solenoid 36. End extension 46 engages test mechanism 200 (shown in FIG. 7) to cause handle 134 to pivot resulting in contacts 140 and 144 separating.

Current sensing components 114 comprise circuit board 34 which is electrically connected to solenoid 36, current sensing transformer 38 and optional to current sensing transformer 38'. Upon receiving signals indicative of an arc fault, circuit board 34 provides a trip signal to trip the arc fault circuit breaker 100.

Twisted pair conductor 158 is electrically interconnected to circuit board 34. Circuit board 34 senses the voltage across the bi-metal resistor 146 and generates a trip signal to actuate solenoid 36 in response to a rapid voltage drop indicative of arcing across the line and neutral leads.

The load current path is completed by electrically interconnecting strap extension 154 and load terminal 156 to a respective distal ends of a wire connector 180. Wire connector 180 can be formed from various suitable conductive materials, e.g., insulated wire, rectangular formed magnetic wire, square formed magnetic wire, or insulated sleeve covered braided copper. Wire connector 180 is routed through a center of sensing transformer 38 such that the flow of the load current through the center of transformer 38 is in a known direction.

The neutral current carrying components 116 within the electronics compartment 112 are electrically connected, e.g., welded, bolted, or crimped, to form a neutral current path for the neutral current. The neutral current path begins at neutral lug 122 where the neutral current enters the electronics compartment 112. Neutral lug 122 secures the neutral lead connected to the load against a neutral terminal 182 to provide electrical continuity thereto. Neutral terminal 182 is electrically connected to neutral return wire 124 via a copper braid 184. An insulated sleeve 186 surrounds a portion of copper braid 184 and provides electrical insulation between copper braid 184 and circuit board 34. Copper braid 184 is routed through the center of sensing transformer 38 such that the flow of the neutral current through the center of transformer 38 is in the opposite direction of the flow of the load current through wire connector 180.

Both the copper braid 184 of the neutral current path, and wire connector 180 of the load current path are routed through the current sensing transformer 38 to sense arcing from line to ground as is well known. This is accomplished by routing the flow of the neutral current through the sensing transformer 38 in the opposite direction to the flow of the load current. The total current flow through sensing transformer 38 thus cancels unless an external ground fault current is caused by arcing from line to ground. The resulting differential signal, sensed by sensing transformer 38, is indicative of the ground fault current and is processed by circuit board 34.

Optional current sensing transformer 38' is used for ground fault applications where a separate sensor is needed to detect improper wiring by the customer, e.g., the neutral current path is wired backwards. That is, copper braid 184 of the neutral current path is routed through the optional current sensing transformer 38'. The resulting signal, sensed by optional current sensing transformer 38', is indicative of the neutral current direction and magnitude, and is processed by circuit board 34.

Figure 7:
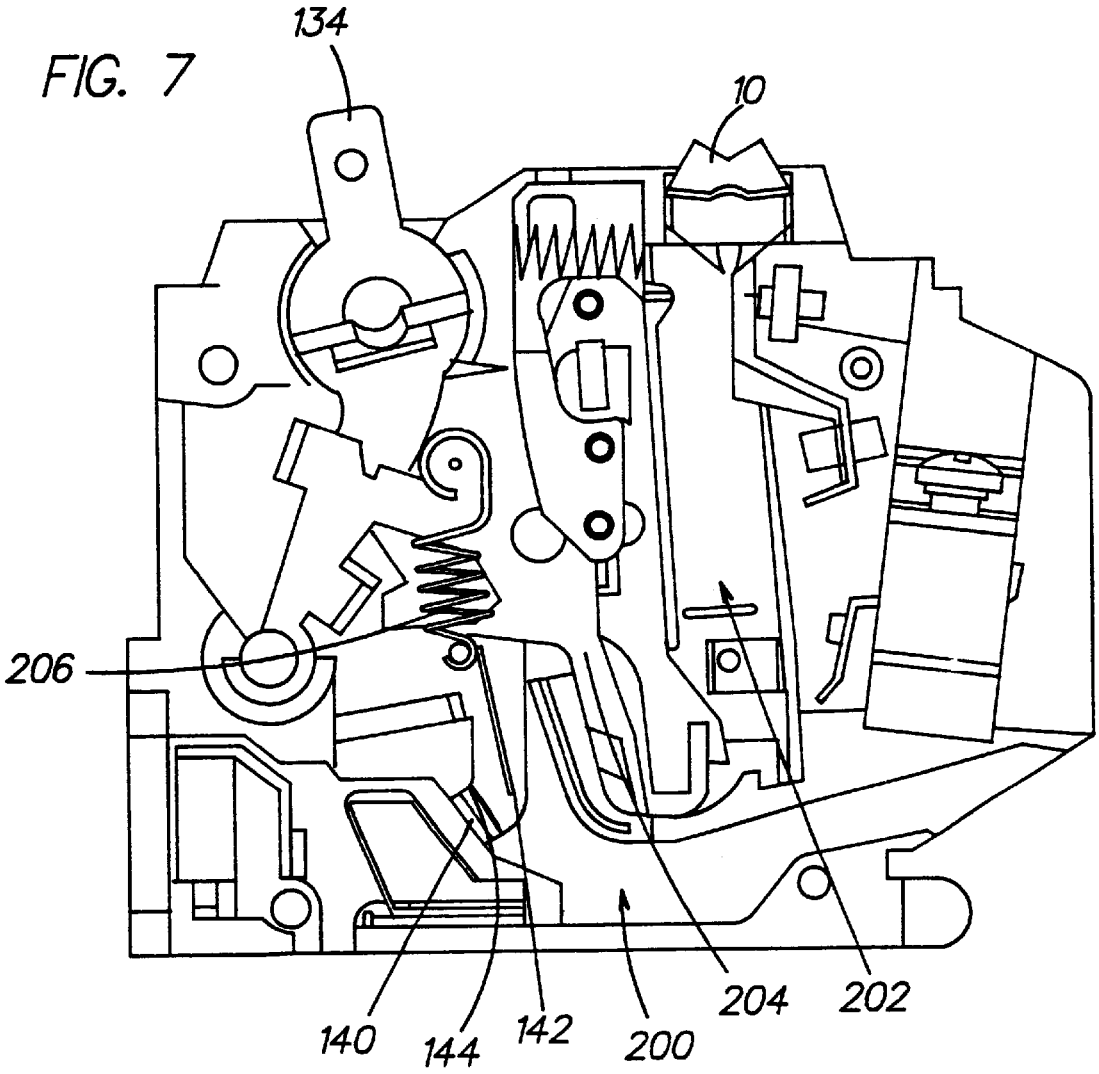
FIG. 7 is a side elevation view of a dual test mechanism including the dual test button of FIG. 1 for use in a circuit breaker in accordance with the present invention.

Turning now to FIGS. 1–8. FIG. 7 illustrates test mechanism 200 in greater detail. It being understood that test mechanism 200 of FIG. 7 is merely exemplary in nature and it is within the scope of the present invention that other known test mechanism 200 may be employed with test button assembly 32 including dual test button 10 and circuit board 34 to cause handle 134 to pivot resulting in contacts 140 and 144 opening to interrupt current during either AFCI or GFCI tnp conditions. Test mechanism 200 includes a latch assembly 202 having a pivotable armature latch (not shown). The pivotable armature latch comprises the main component of test mechanism 200 which interacts with end extension 46 in that upon actuation of solenoid 36, the solenoid rod is driven causing end extension 46 to ride within window 190 (FIG. 6). As end extension 46 is driven itself, it contacts the annature latch causing the armature latch to rotate counterclockwise.

The pivotable armature latch selectively engages and positions a cradle 204 so that when the armature latch is rotated counter clockwise, cradle 204 is released from the armature latch resulting in cradle 204 being free to rotate. Cradle 204 rotates downward in a clockwise manner and falls out of window 190. A spring 206 interconnected between blade 142 and cradle 204 creates a biasing force therebetween so that when cradle 204 rotates clockwise, after being released from the annature latch, the spring biasing forces causes blade 142 and handle 134 to rotate to a trip position, wherein contacts 140 and 144 are opened.

As best shown in FIGS. 2 and 6, a test wire 195 is routed through sensing transformer 38, such that the flow of current in test wire 195 through the center of sensing transformer 38 is in a known direction. During non-test and non-trip conditions, the total current flowing in opposite directions through transformer 38 cancels one another and thus sensing transfonner 38 does not detect a differential signal, which is indicative of a trip or test condition. Test wire 195 is electrically connected to circuit board 34 and test button assembly 32 so that when the second signal (GFCI test signal) is generated when pivotable leaf spring 20 and first flat 40 make contact, a current is passed through test wire 195 causing a current differential through sensing transformer 38. More specifically, one end of test wire 195 is electrically connected to first flat 40 and an opposite end of test wire 195 is electrically connected to horizontal strap extension 154 after test wire 195 has passed through sensing transformer 38.

Referring to FIGS. 1–7, in exemplary circuit breaker 100, the testing of the AFCI circuit proceeds in the following manner. First cantilevered surface 12 of test button 10 is depressed causing pivotable leaf spring 20 to contact second flat 42 resulting in the first signal being injected into circuit board 34. The first signal comprises a test signal for the AFCI circuit of circuit breaker 100 and in response to the first signal, circuit board 34 generates a trip signal which is communicated with solenoid 36. Upon receipt of the trip signal, solenoid 36 is actuated and plunger 44 is driven so that end extension 46 of plunger 44 contacts and causes the armature latch to rotate counter clockwise, thereby releasing cradle 204. This results in handle 134 being rotated causing contacts 140 and 144 to open. Test button 10 is designed so that once first cantilevered portion 12 is no longer depressed, test button 10 moves back to its original off position, wherein pivotable leaf spring 20 is centered and not in contact with either first or second flats 40 and 42. Consequently, after the trip mechanism of circuit breaker 100, including handle 134, blade 142 and contacts 140 and 144 are reset to a non-trip position, test button 10 is in an off position and thus no test signals are being delivered to circuit board 34.

Figure 8:
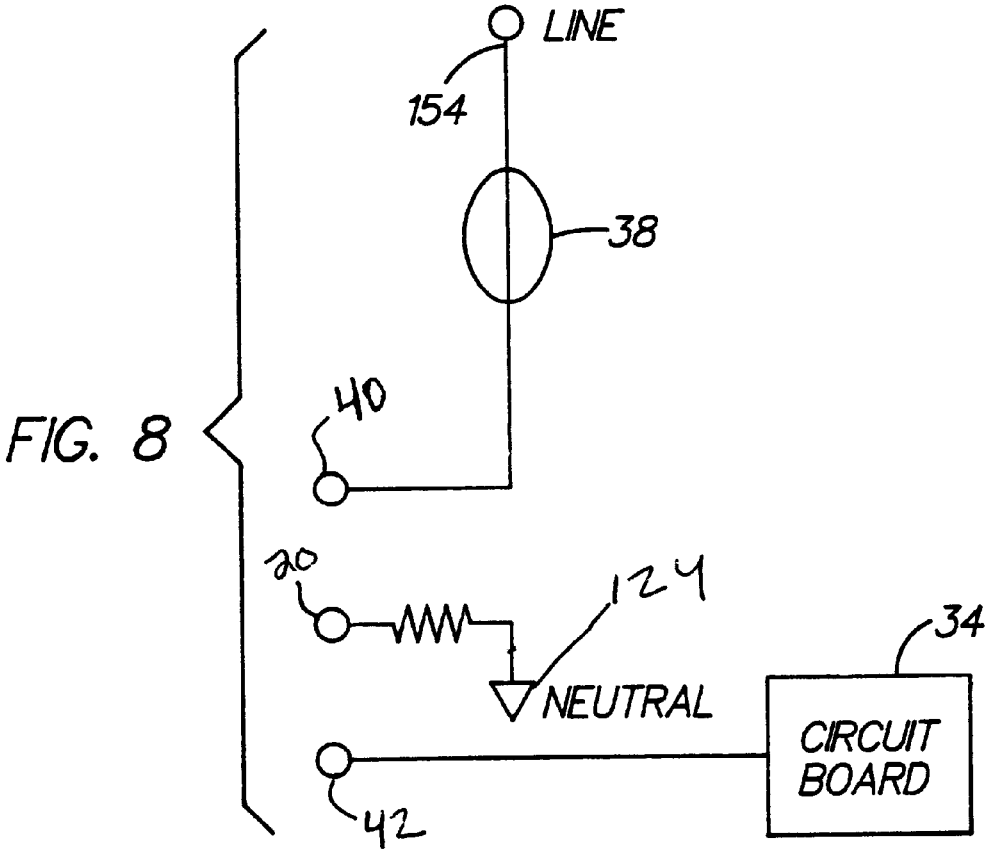
FIG. 8 is a schematic of an exemplary circuit for the dual test button of the present invention.

In order to test the GFCI circuit of circuit breaker 100, second cantilevered surface 14 is depressed causing pivotable leaf spring 20 to contact first flat 40 resulting in the second signal being injected into circuit board 34 in the following manner. Upon contact between pivotable leaf spring 20 and first flat 40, test wire 195, which is routed through sensing transformer 38, carries current through sensing transformer 38 thereby canceling the indifference in total current flowing through sensing transformer 38 because the opposing flow of current through sensing transformer 38 no longer cancels one another. The resulting differential signal, sensed by sensing transformer 38, is indicative of the ground fault current and is processed by circuit board 34. As previously described, in response to the second signal, circuit board 34 generates a trip signal which is communicated with solenoid 36. Upon receipt of the trip signal, solenoid 36 is actuated and engages test mechanism 200 to cause rotation of handle 134 and opening of contacts 140 and 144 in the manner described hereinbefore. FIG. 8 is a schematic of exemplary circuitry for dual test button 10 and is therefore self-explanatory in nature. Thus, the present invention provides a means for providing a first test signal and a second test signal, wherein the first test signal is generated to test the AFCI circuit and the second signal is generated to test the GFCI circuit. Test button assembly 32 is merely one exemplary means for providing these two signals and it is within the scope of the present invention that other means may be used such as a switching device, e.g., toggle switch having two positions which generate first and second test signals.

Of course one of sill in the art would appreciate that the test mechanism 200 and dual test button 10 may be employed in a two pole arc fault circuit breaker. In this embodiment, the AFCI and GFCI of the two pole arc fault circuit breaker are easily and conveniently tested While preferred embodiments have been shown and described, various modifications and substitutions may be made thereto without departing from the spirit and scope of the invention. Accordingly, it is understood that the present invention has been described by way of illustrations and not limitation.

What is claimed is:

1. A test mechanism for a circuit breaker comprising:

a circuit board;

a test button assembly including a test button, the test button including a top portion having first and second cantilevered surfaces, and a bottom portion having a clamp member, the clamp member having a pair of biasing arms pinching a first end of a pivotable conductor to the test button, the pivotable conductor comprising a leaf spring and further comprising a second end, the test button assembly further including signaling components comprising first and second flat conductors which are electrically connected to the circuit board, wherein depressing the first cantilevered surface places the test button in a first position and moves the second end of the pivotable conductor into contact with the second flat conductor to direct a first test signal to the circuit board, and depressing the second cantilevered surface places the test button in a second position and moves the second end of the pivotable conductor into contact with the first flat conductor to direct a second test signal to the circuit board; and a trip mechanism including a pair of separable contacts, the trip mechanism being electrically connected to the circuit board so that in response to receiving one of the first and second test signals, the circuit board generates a trip signal causing the trip mechanism to separate the pair of separable contacts.

2. The test mechanism of claim 1 wherein the circuit breaker includes an arc fault circuit interruption circuit (AFCI) and a ground fault circuit interruption (GFCI) circuit.

3. The test mechanism of claim 2 wherein the first position comprises a test position for the AFCI circuit and the second position comprises a test position for the GFCI circuit.

4. The test mechanism of claim 1 wherein the circuit breaker further includes a current sensing transformer.

5. The test mechanism of claim 4 wherein the first flat conductor is electrically connected to one end of a test wire which passes through the current sensing transformer, an opposite end of the test wire being electrically connected to a bi-metal resistor.

6. The test mechanism of claim 5 wherein the second signal is provided by passing current through the test wire when the pivotable conductor and the first conductive flat are in contact.

7. The test mechanism of claim 1 wherein the trip mechanism includes a pivotable handle.

8. The test mechanism of claim 7 wherein the trip mechanism includes a solenoid which is electrically connected to the circuit board and actuation of the solenoid causes the handle to pivot and separate the contacts.

9. The test mechanism of claim 8 wherein the solenoid is actuated by receipt of the trip signal from the circuit board.

10. A circuit breaker comprising:

a trip unit including a circuit board;

a pair of separable contacts for interrupting the flow of current; and a test mechanism including a test button, the test button including a top portion having first and second cantilevered surfaces, and a bottom portion having a clamp member, the clamp member having a pair of biasing arms pinching a first end of a pivotable conductor to the test button, the pivotable conductor comprising a leaf spring and further comprising a second end, the test button assembly further including signaling components comprising first and second flat conductors, wherein depressing the first cantilevered surface places the test button in a first position and moves the second end of the pivotable conductor into contact with the second flat conductor to direct a first test signal to the circuit board, and depressing the second cantilevered surface places the test button in the second position and moves the second end of the pivotable conductor into contact with the first flat conductor to direct a second test signal to the circuit board, and wherein the circuit board generates a trip signal in response to receiving one of the first and second test signals, the trip signal being delivered to an actuator which causes separation of the contacts.

11. The circuit breaker of claim 10 wherein the first position is for testing an arc fault circuit interruption and the second position is for testing a ground fault circuit interruption.

12. The circuit breaker of claim 10 wherein the actuator comprises a solenoid.

13. The circuit breaker of claim 10, further including an arc fault circuit interruption circuit (AFCI) and a ground fault circuit interruption (GFCI) circuit.

14. The circuit breaker of claim 13 wherein the first position comprises a test position for the AFCI circuit and the second position comprises a test position for the GFCI circuit.

15. The circuit breaker of claim 10 wherein the first flat conductor is electrically connected to one end of a test wire which passes through the current sensing transformer, an opposite end of the test wire being electrically connected to a bi-metal resistor.

16. The circuit breaker of claim 15 wherein the second signal is provided by passing current through the test wire when the pivotable conductor and the first conductor flat are in contact.

* * * * *

UNITED STATES PATENT AND TRADEMARK OFFICE

CERTIFICATE OF CORRECTION

PATENT NO. : 6,259,340 B1
DATED : July 10, 2001
INVENTOR(S) : Fuhr et al.

It is certified that error appears in the above-identified patent and that said Letters Patent is hereby corrected as shown below:

Column 1,
Line 27, after “detected” insert therefor -- . --

Column 5,
Line 30, after “components” delete “wiin” and insert therefor -- within --

Column 6,
Line 57, after “FIGS.” delete “1-8.” and inseert therefor -- 1-8, --

Column 7,
Line 6, after “contacts the” delete “annature” and insert therefor -- armature --
Line 25, before “38 does not” delete “transfonner” and insert therefor -- transformer --

Column 8,
Line 22, after “one of” delete “sill” and insert therefor -- skill --
Line 27, after “tested” insert therefor -- . --

Signed and Sealed this

Twenty-fifth Day of January, 2005

JON W. DUDAS
*Director of the United States Patent and Trademark Office*